US007169022B2

(12) United States Patent
Cutsforth

(10) Patent No.: US 7,169,022 B2
(45) Date of Patent: Jan. 30, 2007

(54) METHOD AND APPARATUS FOR CREATING A GROOVE IN A COLLECTOR RING OF AN ELECTRICAL DEVICE

(75) Inventor: David L. Cutsforth, Cohasset, MN (US)

(73) Assignee: Cutsforth Products, Inc., Cohassett, MN (US)

( * ) Notice: Subject to any disclaimer, the term of this patent is extended or adjusted under 35 U.S.C. 154(b) by 144 days.

(21) Appl. No.: 10/657,512

(22) Filed: Sep. 8, 2003

(65) Prior Publication Data

US 2004/0102143 A1 May 27, 2004

Related U.S. Application Data

(63) Continuation of application No. 09/864,446, filed on May 24, 2001, now Pat. No. 6,652,360.

(51) Int. Cl.
*B24B 1/00* (2006.01)
*H01R 39/08* (2006.01)

(52) U.S. Cl. ..... 451/29; 451/30; 451/51; 451/177; 451/179; 451/394; 451/358; 451/359; 451/364; 451/397; 451/403; 310/232; 310/237; 310/333

(58) Field of Classification Search ..... 451/29, 451/30, 51, 177, 179, 344, 358, 359, 364, 451/397, 403; 310/232, 237, 335
See application file for complete search history.

(56) References Cited

U.S. PATENT DOCUMENTS 3,636,394 A 1/1972 Froste et al.
3,756,099 A 9/1973 Sullivan
3,965,623 A * 6/1976 Grutza et al. ..... 451/46
4,266,154 A * 5/1981 Marshall ..... 310/219
4,355,553 A 10/1982 Church et al.
4,439,913 A * 4/1984 Coquillart ..... 29/597
4,525,957 A 7/1985 Daniels
4,536,915 A 8/1985 Guglielmo
4,587,723 A 5/1986 Scuro
4,726,113 A 2/1988 Shibata et al.
5,065,651 A 11/1991 Amey
5,177,842 A 1/1993 Hongo
5,185,967 A 2/1993 Cutsforth
5,256,925 A 10/1993 Cutsforth (Continued)

*Primary Examiner*—Lee D. Wilson
*Assistant Examiner*—Shantese McDonald
(74) *Attorney, Agent, or Firm*—Crompton, Seager & Tufte, LLC

(57) ABSTRACT

A method and apparatus for creating a groove in the surface of a collector ring for use in an electrical device. The method and apparatus can be used to create a new groove in the surface of a collector ring having none, or can be used to enhance or re-form an existing groove in the surface of a collector ring. In some embodiments, the groove in the surface of the collector ring is created using a cutting tool that has a cutting action that functions independently from the motion of the collector ring. In other embodiments, a masking material is positioned over a portion of the surface of the collector ring to create a masked portion and an exposed portion of the surface of the collector ring. A groove is then created in the exposed portion of the surface of the collector ring. The masking material is then removed from the surface of the collector ring.

16 Claims, 3 Drawing Sheets

U.S. PATENT DOCUMENTS 5,430,938 A * 7/1995 Rao et al. ..... 29/888.074
5,454,284 A 10/1995 Sbalchiero et al.
5,512,011 A * 4/1996 Millas ..... 451/439
5,668,428 A 9/1997 Stojkovich et al.
5,735,045 A * 4/1998 Papayoti ..... 29/889.1
5,779,528 A 7/1998 Tartaglione

* cited by examiner

METHOD AND APPARATUS FOR CREATING A GROOVE IN A COLLECTOR RING OF AN ELECTRICAL DEVICE

This application is a continuation of U.S. patent application Ser. No. 09/864,446, filed on May 24, 2001, now U.S. Pat. No. 6,652,360, wherein such document is incorporated herein by reference.

FIELD OF THE INVENTION

The invention is directed to a method and apparatus for processing a collector ring used in an electrical device. More particularly, the invention relates to a method and apparatus for creating a groove or grooves on the surface of collector ring used in an electrical device.

BACKGROUND OF THE INVENTION

It is known to provide a spiral groove in the carbon brush contact surfaces of collector rings, particularly in collector rings of large industrial electrical generators or motors, and similar machinery. The grooves can serve various purposes. For example, the grooves help to reduce selective action of the brushes, which can cause catastrophic failure of the brush to ring contacts. After wear due to prolonged use, or after turning down, or re-truing of the collector ring contact surfaces, the grooves can be worn away, or become to shallow for optimal operation. For example, if the collector ring goes out of round, and needs to be re-trued, the re-truing operation can wear away the groove. Therefore, in such situations, the groove must be re-form-ed or enhanced in the contact surfaces of the collector rings. However, many of the known processes for initially creating such grooves, or for re-forming or enhancing such grooves are difficult to perform or are very time consuming. Therefore, it would be desirable to provide a new method and apparatus for creating or recreating grooves in the surfaces of collector rings.

SUMMARY OF THE INVENTION

One aspect of the invention relates to a method and apparatus for creating a groove in the surface of a collector ring for use in an electrical device. It is contemplated that the method and apparatus can be used to create a new groove in the surface of a collector ring having none. It is also contemplated that the method and apparatus can be used to enhance or re-form an existing groove in the surface of a collector ring.

One embodiment includes creating a groove in a surface of a collector ring by cutting the groove using a cutting tool that has a cutting action that functions independently from the motion of the collector ring.

Another embodiment includes positioning a covering or masking material over a portion of the surface of the collector ring to create a masked portion and an exposed portion of the surface of the collector ring. A groove is then created in the exposed portion of the surface of the collector ring. The masking material is then removed from the surface of the collector ring.

DETAILED DESCRIPTION OF THE INVENTION

The following detailed description should be read with reference to the figures, in which like elements in different figures are numbered in like fashion. The figures, which are not necessarily to scale, depict selected embodiments and are not intended to limit the scope of the invention. In some cases, the figures may be highly diagrammatic in nature. Examples of constructions, materials, dimensions, and manufacturing processes are provided for various elements. Those skilled in the art will recognize that many of the examples provided have suitable alternatives that may be utilized.

Figure 1:
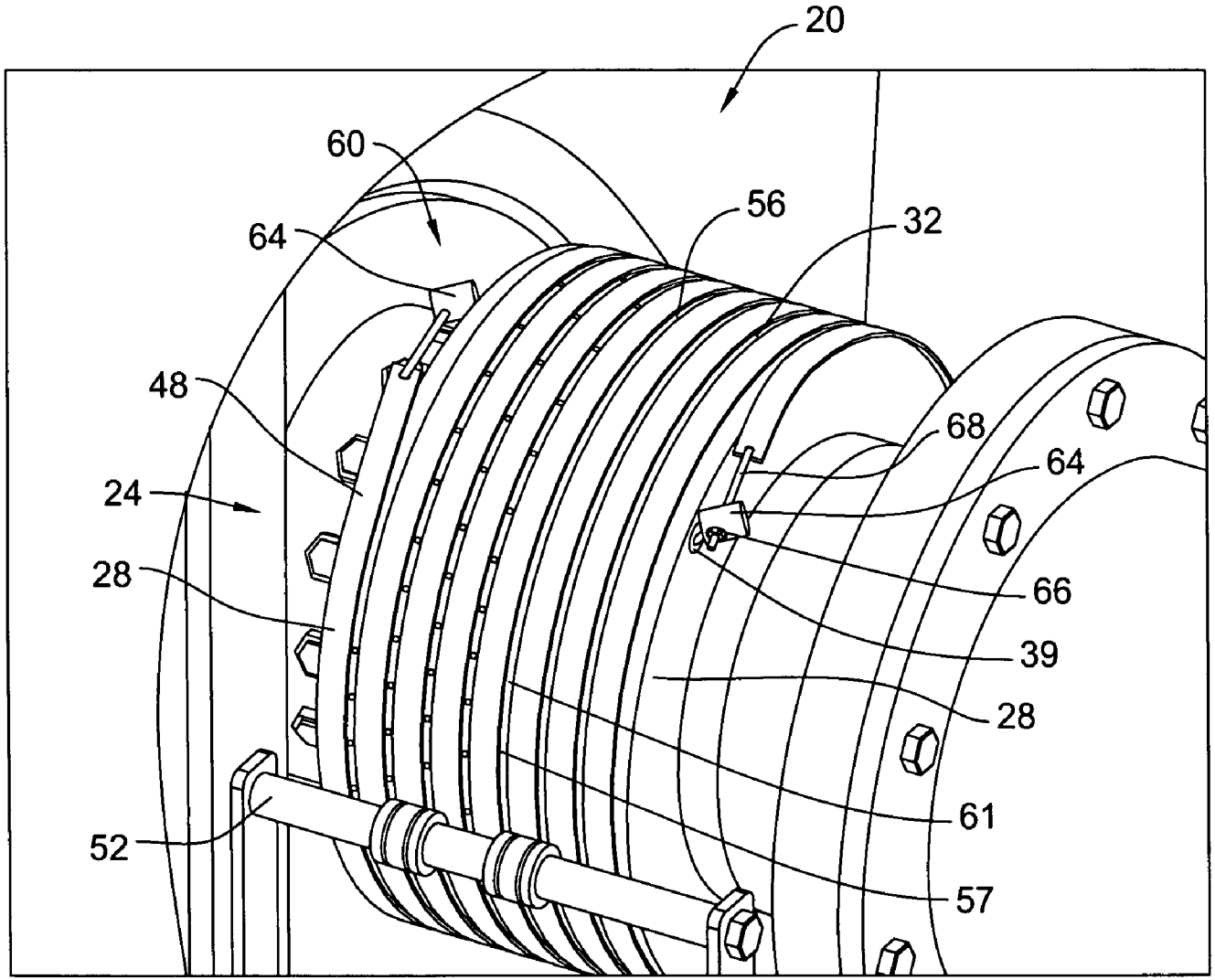
FIG. 1 is a photograph showing a partial perspective view of a large industrial rotating electrical device including a cylindrical collector ring having helical grooves in the outer peripheral surface thereof, and a banding coupled to the outer peripheral surface in accordance with one aspect of the invention.

FIG. 1 is a perspective photograph of a portion of a rotating mechanism 20 from an electrical generator. The rotating mechanism 20 includes at least one collector ring 24. In general, collector rings are structures within generators or motors that are adapted and configured to interact with or to be a part of a sliding connection to complete a circuit between a fixed and a moving conductor. For example, in at least some generators or motors, the collector rings are adapted and configured to complete a circuit with brush assemblies or riggings within the generator or motor. In FIG. 1, the brush assemblies or riggings (not shown) have been removed to better expose the surface 32 of the collector ring 24. Those of skill in the art and other will recognize that the size and configuration of the collector rings may vary, depending greatly upon the type and size of the generator or motor in which they are used.

Figure 2:
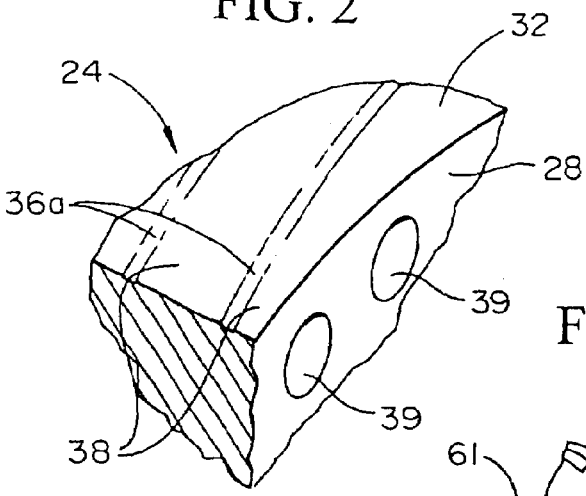
FIG. 2 is a partial cutaway perspective view of the collector ring of FIG. 1, without the banding coupled to the outer surface thereof, and showing worn grooves therein.

Referring to both FIGS. 1 and 2, the cylindrical collector ring 24 includes side surfaces 28 and an outer peripheral surface 32. In this particular embodiment, the outer peripheral surface 32 includes one or more existing grooves **36*a*, and one or more non-grooved portions 38, as seen best in FIG. 2. Preferably, the existing groove 36*a* is a continuous helical, or spiral shaped groove about the outer peripheral surface 32 of the collector ring 24. The side surfaces 28 define a series of spaced apertures 39 therein proximate the outer peripheral surface 32**.

FIG. 1 also shows a masking material 48 that has been placed about the outer peripheral surface 32 of the collector ring 24, and a guide bar 52 situated proximate the surface 32 of the collector ring. The masking material 48 and the guide bar 52 are not part of the structure of the collector ring 24, but are structures used in accordance with one illustrative embodiment of a method of forming a groove in the surface 32 of the collector ring 24, as will be discussed in greater detail below.

Referring to FIG. 2, the existing groove 36*a* appears to be shallow and not well defined, due possibly to wear, or to turning down or re-truing of the collector ring. It is desirable to create a new groove in the surface of the collector ring to re-form or enhance the existing groove 36*a*.

Figure 3:
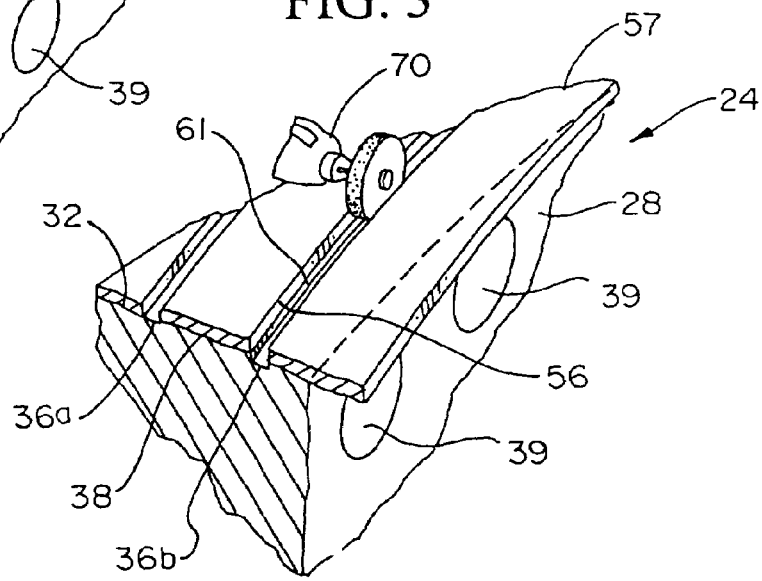
FIG. 3 is a partial cutaway perspective view of the collector ring of FIG. 1, showing the banding coupled to the outer surface thereof and a grinding tool forming a groove in the outer surface in accordance with another aspect of the invention.
Figure 4:
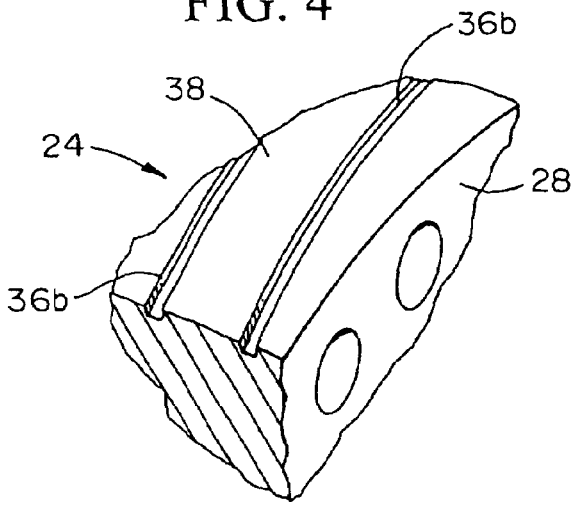
FIG. 4 is a partial cutaway perspective view of the collector ring of FIG. 1, with the banding material removed, and a new groove in the outer surface in accordance with another aspect of the invention.

Referring to FIGS. 1–4, one embodiment of the invention includes a method of creating a new groove 36*b* in a surface of the collector ring 24. In this embodiment, the groove 36*b* being created is in essence an enhancement or re-creation of the existing groove 36*a*. FIGS. 2, 3, and 4 show a progression of a method in accordance with one embodiment of the invention, with FIG. 2 showing the collector ring 24 prior to performance of the method, FIG. 3 showing the collector ring during the performance of the method, and FIG. 4 showing the collector ring 24 after the performance of the method.

Referring now to FIGS. 1 and 3, the brush assemblies (not shown) are removed to expose the collector ring 24, and the masking material 48 is positioned over a portion of the surface 32 of the collector ring 24 to define a masked portion 57 and an exposed portion 61. The masking material 48 is positioned about the outer peripheral surface 32 over the non-grooved portions 38, and adjacent the existing groove 36*a*. Therefore, the exposed portion 61 and the existing groove 36*a* are substantially the same. It should be understood that in some other embodiments, it is contemplated that the masking material will not be positioned adjacent the existing grooves, or in yet other embodiments, the collector ring does not include existing grooves. In such embodiments, the exposed portion and any existing grooves will not be substantially the same.

Preferably, the masking material 48 defines one or more tracks 56 that are formed adjacent the existing grooves 36*a*. The track 56 has the same general width as the width of the existing groove 36*a*. In some other embodiments, it is contemplated that the track can have a width that is narrower or wider than the existing groove. In any event, it is preferable that the track 56 has a width that is substantially the same as the desired width of the new groove 36*b* to be created.

The masking material 48 can be any of a broad variety of materials generally known that can be appropriately positioned on the collector ring 24. It is preferred that materials used as the masking material are adapted and configured to serve the function of defining a rigid track 56 that can be used as an appropriate guide when creating the new groove or grooves. The masking material can include one continuous piece of material, or can be made up of two or more individual pieces of material.

Some examples of suitable masking materials include a band or multiple bands of rigid material that are appropriately sized and shaped to be positioned about the collector ring to form the necessary tracks for the creation of the desired grooves having the required shape, size and spacing. Some examples of suitable materials include metals, rigid polymers, and other like material. In some preferred embodiments, the masking material 48 is a single continuous band of steel positioned about the circumferential outer surface of the collector ring 24.

The masking material 48 can be maintained in position about the surface of the collector ring 24 using any of a broad variety of techniques. For example, the masking material 48 can be maintained in position using adhesives, mechanical fasteners, or the like or any combinations thereof. Suitable adhesives include any inorganic or organic adhesive that can function to maintain the masking material 48 in position, but that preferably allows for removal of the masking material 48 when desired. Some preferred adhesives include pressure sensitive adhesives, for example pressure sensitive compositions or tapes, and the like. Suitable mechanical fasteners include any mechanism, device, member, or collection of such mechanisms, devices, or members that can function to maintain the masking material 48 in position, but that allows for removal of the masking material 48 when desired. Some examples of mechanical fasteners include mechanical arrangements including clamps, pins, springs, hooks, screws, nuts and bolts, hook and loop type fasteners, and the like.

In FIG. 1, the masking material 48 is maintained on the collector ring 24 using a mechanical mechanism 60 including two pin members 64, and two nuts 66 and bolt 68 assemblies. Each pin member 64 includes a channel there through, and is inserted into one of the spaced apertures 39 in the side surfaces 28. Each of the bolts 68 includes a first end adapted to engage an end of the band material 48, and a second threaded end adapted to extend through the channel in the pin member 64, and engage the nut 66. The pin members 64 are inserted into appropriate apertures 39 such that as nuts 66 are tightened onto the bolts 68, the masking material 48 is biased against the surface 32 of the collector ring 24, and maintained in position. Additionally, a pressure sensitive foam has been placed between the surface 32 and the masking material 48.

Referring to FIG. 3, once the masking material 48 is positioned appropriately on the surface 32 of the collector ring 24, the groove 36*b* is created in the exposed portion 61 of the surface 32 of the collector ring 24. The groove 36*b* can be created using any known technique. For example, any known grinding, cutting, machining, etching, or other like technique can be used. Preferably, the groove is created using a cutting technique that is not dependent upon the motion of the object being ground, i.e. the collector ring, for the cutting action. In other words, preferably, the groove is created using a cutting tool that has a cutting action that is independent of the motion of the collector ring. It is preferable that the cutting action of a cutting tool used to create the groove does not require that the collector ring be rotated or spun to create or induce the actual cutting action of the tool. For example, preferably the collector ring does not need to be rotated or spun like a lathe to create cutting action from a stationary cutting tool such as a stationary grinding stone, a chisel, or other like stationary cutting device or tool. In fact, in some embodiments, the use of a tool that is not dependent upon the motion of the collector ring for the creation of the groove is of great benefit, and can provide for very quick creation of the groove. Additionally, the amount of preparation time and equipment necessary to create the groove can often be reduced by using such a tool, especially as compared to the use of stationary cutting tools that require the rotation of the collector ring. Preferably, the groove is created using a grinding tool 70. Preferably, the grinding tool 70 is a high speed grinding tool that has a cutting action that is independent of the motion of the collector ring. For example, a rotary grinding tool, or other like tools, are particularly useful.

In some embodiments, as the groove 36*b* is being created, the collector ring 24 can be rotated to expose new portions of the surface 32 of the collector ring 24 in which the groove

36*b* is being created. However, such rotation of the collector ring 24 is different from, and should be distinguished from rotation of the collector ring that is done to create cutting action for a stationary tool.

Also, FIG. 1 shows a guide bar 52 situated proximate the surface 32 of the collector ring 24. The guide bar 52 can be used to help steady or guide the cutting tool 70 being used to create the groove 36*b*. For example, a portion of the tool 70 can be rested on the guide bar 52 while the groove 36*b* is being created. Additionally, the guide bar can aid in maintaining a consistent depth of the groove 36*b* being created.

In some embodiments, it is contemplated that a cutting tool that has a cutting action independent of the motion of the collector ring can be connected or fixed to a guide bar proximate the surface of the collector ring. For example, a rotary grinder could be mounted to a guide-bar proximate the surface of the collector ring in a position for cutting a groove in the surface of the collector ring. It is also contemplated that in such an embodiment, the guide-bar can include a mechanism that allows for the lateral movement of the cutting tool along the surface of the collector ring such that spiral or helical grooves can be cut into the surface of the collector ring as the collector ring is rotated. Such a mechanism would preferably include a linkage mechanism that would correlate the lateral movement of the tool along the guide-bar with the speed of rotation of the collector ring such that the spiral or helical portions of the groove would be appropriately spaced.

The width and depth of the groove 36*b* being created can vary depending upon the particular use and desired characteristics of the collector ring being processed. In some examples, the groove 36*b* preferably has a width ranging from about 1/16 to about 3/8 of an inch, more preferably in the range of about 3/32 to about 5/16 of an inch, and most preferably in the range of about 1/8 to about 1/4 of an inch. In some examples, the groove 36*b* preferably has a depth ranging from about 0.02 to about 0.375 of an inch more preferably in the range of about 0.05 to about 0.200 and most preferably in the range of about 0.063 to about 0.150 of an inch.

After the creation of the groove 36*b* has been completed, the masking material can be removed from the surface 32 of the collector ring 24, as shown in FIG. 4. The collector ring 24 can thereafter be put back into service. Typically, the collector ring does not need to be removed from the electrical device to perform the method. However, it is contemplated that the method can be used on collector rings that have been removed from, or have yet to be placed into, an electrical device.

Although the above embodiment demonstrates the use of the invention to re-form or enhance a worn existing groove on a collector ring, it should be understood that the invention could be performed to de-burr, enhance, or enlarge a groove that is not necessarily worn, but is in need of processing. It should also be understood that the method can be performed on collector rings that have no existing grooves either because no grooves have yet been formed in the ring, or because any existing grooves were completely removed by wear or by truing or turning down of the collector ring. In other words, it is not necessary that the collector ring have an existing groove or grooves prior to the performance of the method.

Figure 5:
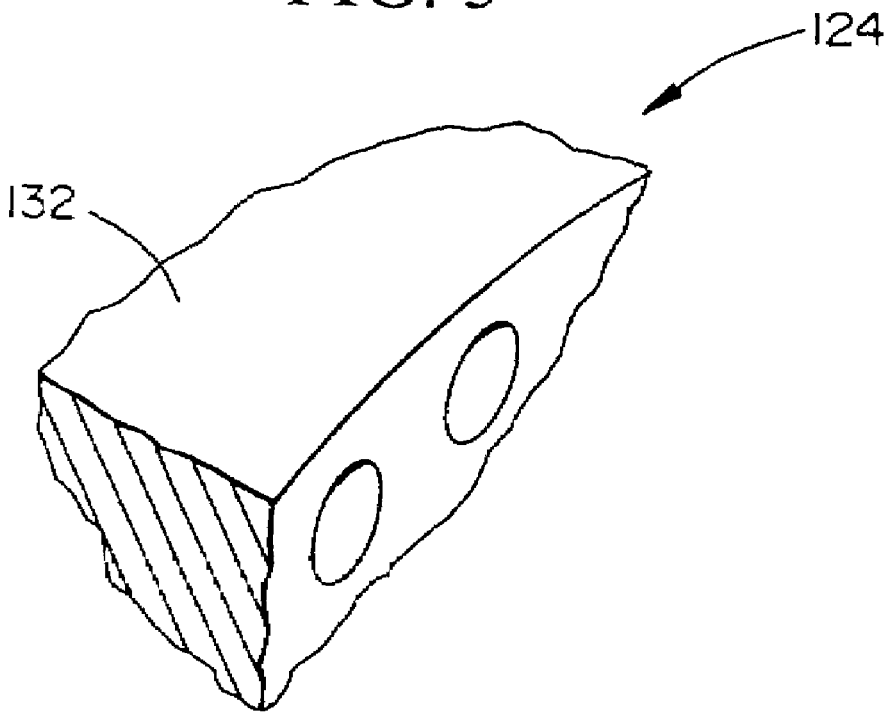
FIG. 5 is a partial cutaway perspective view of a collector ring in accordance with another embodiment of the invention similar to that of FIG. 2, but wherein the outer surface thereof does not include grooves therein.

For example, in accordance with another illustrative embodiment, FIG. 5 shows a collector ring 124 substantially similar to the one shown in the first embodiment described above, but without existing grooves 36*a*. A method in accordance with the invention can be used to create a new groove in the surface 132 of the collector ring 124. The method is substantially similar to that described above. A masking material would be positioned over a portion of the surface 132 of the collector ring 124 to define a masked portion and an exposed portion. The masking material preferably forms a track that defines the exposed portion. A groove would be created in the exposed portion of the surface of the collector ring, preferably through the use of a grinding tool. The masking material would then be removed from the surface of the collector ring 124 leaving the newly created groove in the surface thereof.

Figure 6:
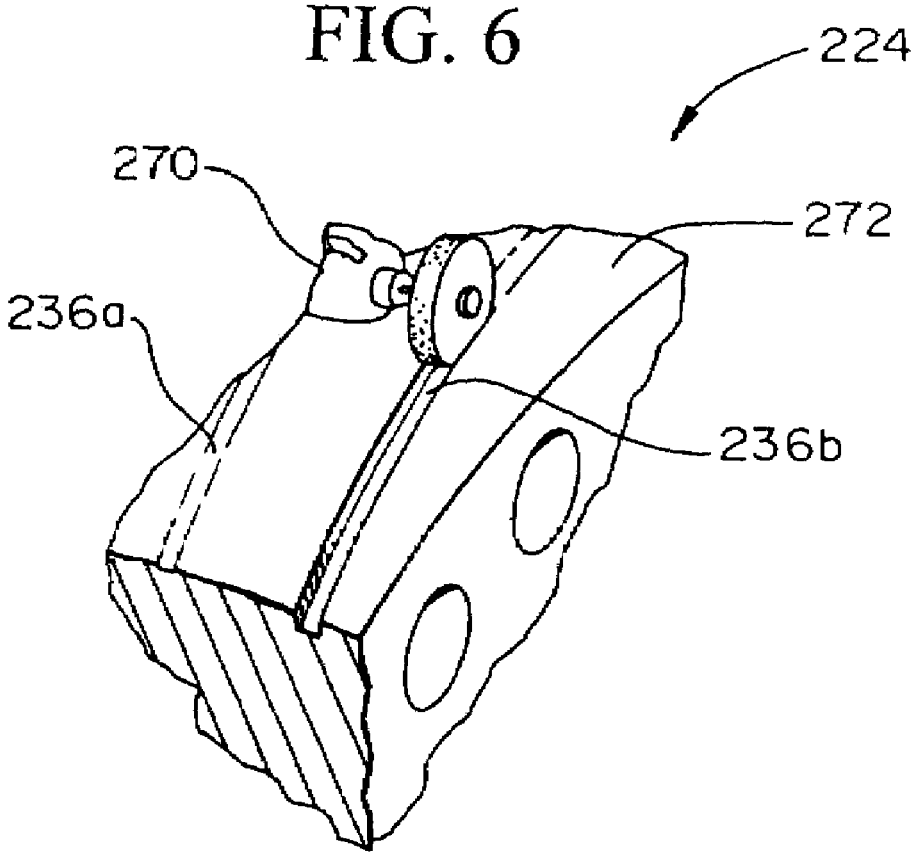
FIG. 6 is a partial cutaway perspective view of a collector ring in accordance with another embodiment of the invention similar to that of FIG. 3, but wherein a masking material is not used in the method of creating the groove.

While the above-disclosed embodiments using a masking material to create a groove or recreate, re-form or enhance a worn existing groove on a collector ring, it should be understood that in some embodiments, the use of a masking material is not required. For example, in accordance with another illustrative embodiment, FIG. 6 shows a collector ring 224 substantially similar to the one shown in the first embodiment described above, including an existing groove 236*a*. A method in accordance with the invention can be used to create a new groove 236*b* in the surface 232 of the collector ring 224 without the use of a masking material. The method is substantially similar to that described above, however, no masking material is positioned over the surface 232 of the collector ring 224. The groove 236*b* is created in the exposed portion of the surface of the collector ring through the use of a cutting tool 270. The cutting tool 270 is of a type that is not dependent upon the motion of the collector ring for cutting action. In other words, the cutting tool 270 has a cutting action that functions independently from the motion of the collector ring 224. Preferably, the groove 236*b* is created using a grinding tool. Preferably, the grinding tool is a high speed grinding tool, for example, a rotary grinding tool, or other like tools.

Additionally, some embodiments of the method and apparatus of the invention are particularly well suited for use on large collector rings, for example for use on collector rings of large industrial electrical generators or motors. It is particularly useful for collector rings of power plant turbine generators. In the embodiment shown in FIG. 1, the collector ring 24 is a field collector ring from a 850 megawatt General Electric generator from a nuclear power plant.

Having thus described the preferred embodiments of the present invention, those of skill in the art will readily appreciate that yet other embodiments may be made and used within the scope of the claims hereto attached. Numerous advantages of the invention covered by this document have been set forth in the foregoing description. It will be understood, however, that this disclosure is, in many respects, only illustrative. Changes may be made in details, particularly in matters of shape, size, and arrangement of parts without exceeding the scope of the invention. The invention's scope is, of course, defined in the language in which the appended claims are expressed.

What is claimed is:

1. A method of creating a groove in a surface of a collector ring of an electrical device, the method comprising:

cutting the groove in the surface of the collector ring using a hand held rotary grinder;

wherein the collector ring remains coupled to at least a portion of the electrical device when creating the groove in the surface of the collector ring.

2. The method of claim 1, wherein the electrical device comprises a large industrial generator.

3. The method of claim 1, wherein the electrical device comprises an industrial power plant generator.

4. The method of claim 1, wherein the electrical device comprises an electrical motor.

5. The method of claim 1, wherein the groove is not present before the method is performed.

6. The method of claim 1, wherein the groove has a first depth before the method is performed and a second depth after the method is performed and wherein the second depth is greater than the first depth.

7. The method of claim 6, wherein the finished depth of the groove is between 0.02 inches and 0.375 inches.

8. A method of creating a groove in a surface of a collector ring for use in an industrial power plant generator, the method comprising:

cutting the groove in the surface of the collector ring using a hand held rotary grinder. wherein the collector ring remains coupled to at least a portion of the electrical generator when creating the groove in the surface of the collector ring; and wherein the collector ring is cylindrical in shape with an outer peripheral surface, the groove being formed around the outer peripheral surface.

9. The method of claim 8, wherein the groove that is created is a helical shaped groove about the surface of the collector ring.

10. The method of claim 8, wherein the groove forms a helical or spiral shape about the outer peripheral surface of the cylindrical collector ring.

11. The method of claim 8, wherein the groove is not present before the method is performed.

12. The method of claim 8, wherein the groove has a first depth before the method is performed and a second depth after the method is performed and wherein the second depth is greater than the first depth.

13. The method of claim 12, wherein the finished depth of the groove is between 0.02 inches and 0.375 inches.

14. A method of creating a groove in a surface of a collector ring of an electrical device, the method comprising:

cutting the groove in the surface of the collector ring using a cutting tool that has a cutting action that functions independently from the motion of the collector ring;

wherein the groove is not present before the method is performed; and wherein the collector ring remains coupled to at least a portion of the electrical device when creating the groove in the surface of the collector ring.

15. A method of creating a groove in a surface of a collector ring of an electrical device, the method comprising:

cutting the groove in the surface of the collector ring using a cutting tool that has a cutting action that functions independently from the motion of the collector ring;

wherein the groove has a first depth before the method is performed and a second depth after the method is performed and wherein the second depth is greater than the first depth; and wherein the collector ring remains coupled to at least a portion of the electrical device when creating the groove in the surface of the collector ring.

16. The method of claim 15, wherein the finished depth of the groove is between 0.02 inches and 0.375 inches.

* * * * *